US005194687A

United States Patent [19]

Garfinkle

[11] Patent Number: 5,194,687

[45] Date of Patent: Mar. 16, 1993

[54] MEANS OF DISABLING TACTICAL ARMORED VEHICLES

[76] Inventor: Moishe Garfinkle, P.O. Box 15855, Philadelphia, Pa. 19103

[21] Appl. No.: 846,020

[22] Filed: Mar. 5, 1992

[51] Int. Cl.[5] ..... F42B 13/00; F42B 23/04

[52] U.S. Cl. ..... 89/1.11; 102/367; 102/370; 102/473

[58] Field of Search ..... 102/367-370, 102/473; 89/1.11

[56] References Cited

U.S. PATENT DOCUMENTS

| | | | |
|---|---|---|---|
| 4,196,668 | 4/1980 | Morlock et al. | 102/473 |
| 4,205,588 | 6/1980 | Phillips | 89/1.11 |
| 4,353,303 | 10/1982 | Bell | 102/367 |
| 4,418,623 | 12/1983 | Gauchard | 102/369 |
| 4,522,126 | 6/1985 | Bell | 102/370 |
| 4,708,869 | 11/1987 | Koblin | 102/370 |
| 4,852,453 | 8/1989 | Morin | 89/1.11 |
| 4,957,027 | 9/1990 | Cherry | 89/1.11 |
| 4,976,202 | 12/1990 | Honigsbaum | 102/367 |

*Primary Examiner*—David H. Brown

[57] ABSTRACT

Rather than physically disabling tactical armored vehicles such vehicles can be rendered equally ineffectual as weapon systems by attenuating or distorting the electromagnetic radiation necessary to their control, communications, and target acquisition ability. This objective can be achieved by blanketing a portion of such vehicles with a rigid polymeric foam within which is dispersed metallic flakes. Upon activation of the foaming system by a proximity fuse foam is generated and ejected from the warhead. The foam expands and solidifies on ports, emitters or receptors of tactical armored vehicle, generally within a second or so after delivery, attenuating or distorting visible, radio-frequency, and microwave radiation sufficiently to destroy the effectiveness of the vehicle. The surface condition of the vehicle is of secondary importance, as chemical adhesion is not relied upon. Accordingly, neither rain nor a light covering of snow or sand will adversely alter the effectiveness of the electromagnetic isolation provided by the foam.

1 Claim, 3 Drawing Sheets

MEANS OF DISABLING TACTICAL ARMORED VEHICLES

BACKGROUND OF THE INVENTION

With the continuing development of advanced light composite armor plate with kinetic penetration resistance greatly exceeding that even imagined just a decade ago, the importance of tactical armored vehicles to battlefield control has grown in importance after a period of decline. In response to this development the throwing weight required to penetrate such tactical armored vehicles has increased roughly in proportion to the effectiveness of advanced armor plate. In consequence of this requirement for higher throwing weights delivery systems can now exceed the maximum weight allowances for personal infantry weapons, rendering existing personal anti-armor weapons largely ineffectual.

This ineffectiveness of infantry weapons against tactical armored vehicles greatly complicates field tactics inasmuch as battlefield control must pass to units outside the direct control of field commanders, principally to aerial weapon platforms that are not only subject to hostile suppression, but to heavy rain, snow or sand storms that can render them ineffectual at critical periods, as can fog and battlefield smoke.

OBJECTIVE OF THE INVENTION

Rather than physically disabling tactical armored vehicles it is proposed that such vehicles be rendered deaf, dumb and blind by blanketing a portion of such vehicles with a rigid polymeric foam. Thus the visual electromagnetic radiation necessary to the control of such vehicles is blocked, thereby rendering such vehicles inoperable. By dispersing metallic flakes in the foam all the electromagnetic radiation necessary to the control, communications, and target acquisition ability of such vehicles is either blocked, attenuated or distorted, thereby fully rendering tactical armored vehicles ineffectual as weapon systems.

The electromagnetic radiation affected falls into three categories:

1) Visual frequencies: ports and periscopes required for visual information are blocked, rendering such vehicles effectively blind.
2) Microwave frequencies: radar signals required for target acquistion are distorted, rendering such vehicles effectively deaf.
3) Radio frequencies: signals required for communication are attenuated, rendering such vehicles effectively dumb.

The psychological effect of the loss of outside contact on the crew of the target vehicle in an active battle zone will probably lead to panic and subsequent abandonment of the vehicle. If not, to remain with the vehicle in an active battle zone with loss of knowledge of the whereabouts of friend or foe, nor with the means of acquiring such knowledge, will require extreme discipline. If visual contact can be restored by using an observer in an open hatch, then in all probably the vehicle will retire from the battle zone, inasmuch as the exposed observer will be outside the protective envelope of an armored vehicle whose weapon and communication systems are ineffectual.

The required foam is ejected from a warhead such as shown in FIGS. 1A through 1F. Upon activation of the foaming system by a proximity fuse the foam is generated and ejected from the warhead. The foam expands and solidifies on ports, emitters or receptors of tactical armored vehicle, generally within a second or so after delivery, attenuating or distorting visible, radio, and microwave radiation sufficiently to destroy the effectiveness of the vehicle. Accordingly, because ballistic penetration of the tactical armored vehicle is not required, the warhead can be relatively light compared to that necessary for penetration, and therefore so can be the delivery system.

The required rigid foam can be created several systems. The foaming systems described herein have been proven in commercial practice, and are designated the one-component system and the two-component system.

In accordance with the one-component system, the polymeric component is combined with a volatile solvent under pressure within a suitable chamber. Foaming occurs on release of the pressure. An example of the one-component system would be the heptane foaming of polystyrene. Another example of a physical foaming agent is 2,2-dimethylpropane, with a normal boiling point of 9.5° C.

In accordance with the two-component system, the reactants are kept apart by a separator. Polymerization and foaming occurs simultaneously on rupture of the separator. An example of the two-component system is the reaction of isocyanate with a water-polyol solution to form a polyurethane foam. Another chemical blowing agent is sodium borohydride, which forms hydrogen when contacted by virtually any proton donor.

To be effective, the components must be ejected from the warhead within the period between proximity activation of the ignition fuse and target contact. This ejection can be accomplished by a pyrotechnic gas generator. Because solidification occurs after contact with the target vehicle, the foam expands in contact with the vehicle and therefore mechanically adheres to structural irregularities on the vehicle. Accordingly, the surface condition of the vehicle is of secondary importance, as chemical adhesion is not relied upon and consequently neither rain nor a light covering of snow or sand will adversely alter the effectiveness of the electromagnetic isolation provided by the foam.

Inasmuch as the invention disclosed herein relates solely to the foaming system, details of the warhead, fusing and delivery system are not shown.

PREFERRED EMBODIMENT OF THE INVENTION

Figure 1A:
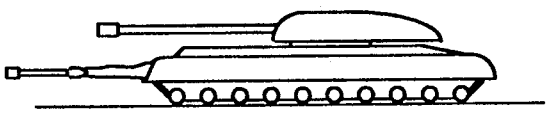
FIGS. 1A through 1C illustrate a possible foam coverage of target resulting from a frontal warhead strike.
Figure 1B:
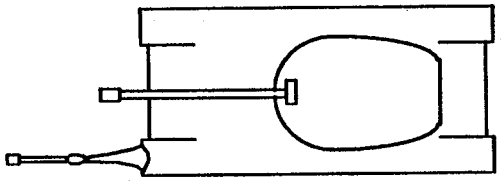
Figure 1C:
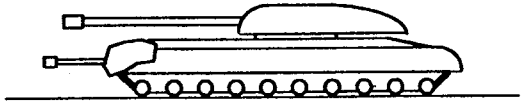
Figure 1D:
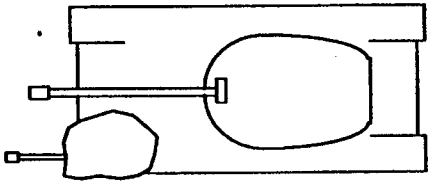
FIGS. 1D through 1F illustrate a possible foam coverage of target resulting from an oblique warhead strike.
Figure 1E:
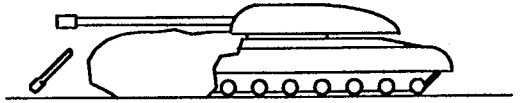
Figure 1F:
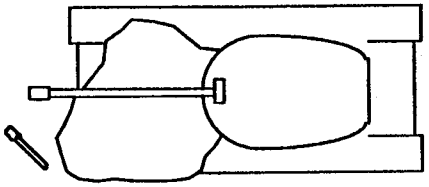
Figure 1G:
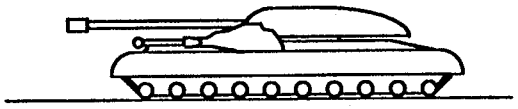
Figure 1H:
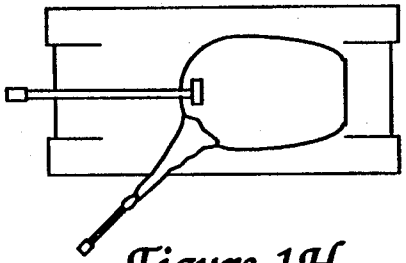
Figure 1I:
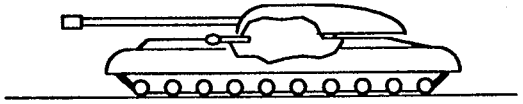
Figure 1J:
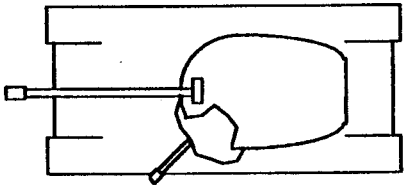
Figure 1K:
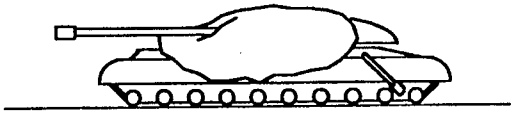
Figure 1L:
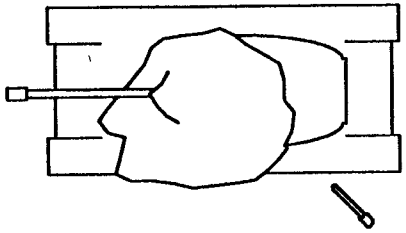
Figure 2:
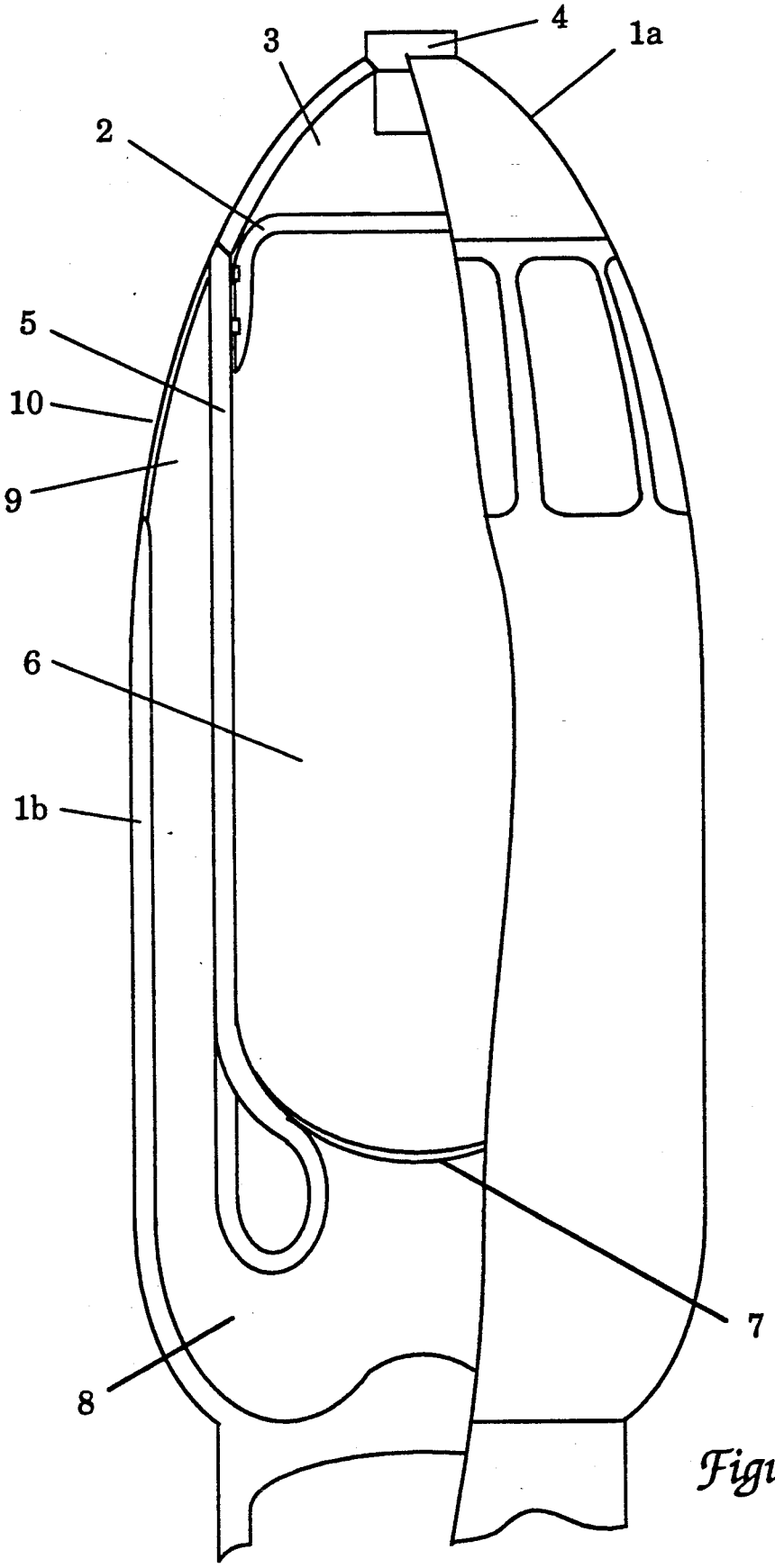
FIG. 2 is a side view of a tactical warhead with a one-component foaming system.
Figure 3:
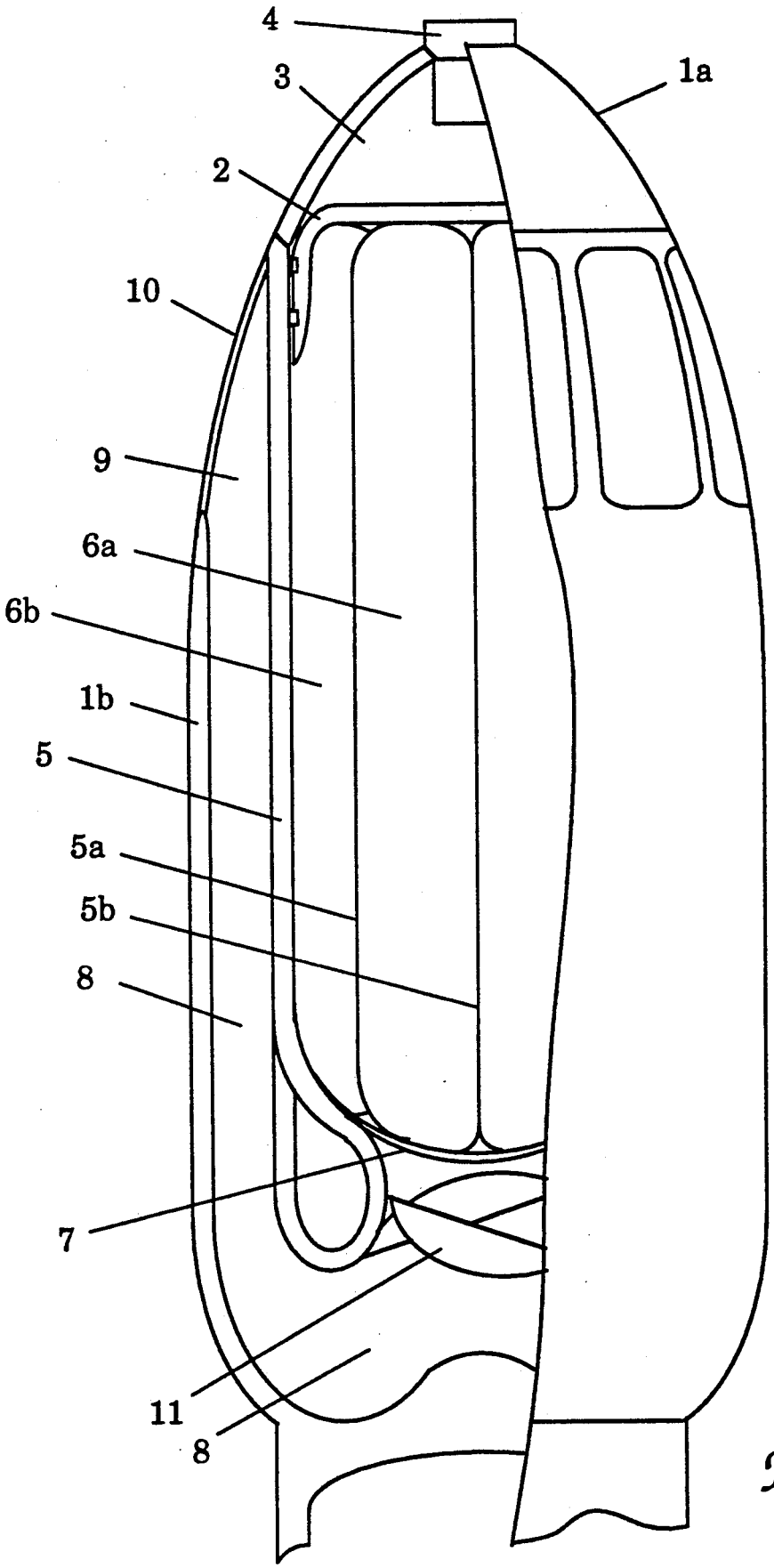
FIG. 3 is a side view of a tactical warhead with a two-component foaming system.

FIGS. 2 and 3 illustrate the preferred embodiments of the tactical warhead configuration. The inner case 1a and piston 2 confine the gas-generator charge 3. The charge 3 is ignited by an ignition fuse 4 triggered by a proximity device. The expanding gas formed by charge 3 drives piston 2 into polymeric component chamber 5, expelling foaming components 6 from chamber 5.

In the case of the one-component system chamber 5 contains a pressurized volatile solvent into which the foam component 6 is dissolved and throughout which is suspended metallic flakes. Upon the displacement of piston 2 into chamber 5 diaphragm 7 bursts and fragments, with gas pressure from charge 3 expelling the dissolved and suspended components into connecting passages 8 within outer case 1*b* wherein foaming initiates. The foam exits through orifices 9, ejecting protective shields 10. Foaming is completed in contact with the target.

In the case of the two-component system chamber 5 holds plastic film bags 5*a* and 5*b* containing the two reactive components 6*a* and 6*b* respectively. Throughout reactive components 6*a* and 6*b* are suspended metallic flakes. Upon the displacement of piston 2 into chamber 5 diaphram 7 bursts and fragments, with gas pressure from charge 3 expelling the two components 6*a* and 6*b* through the static mixers 11 which mix the two components 6*a* and 6*b* and shred the plastic film bags 5*a* and 5*b*. The components subsequently pass through connecting passages 8 within outer case 1*b* wherein foaming initiates. The foam exits through orifices 9, ejecting protective shields 10. Foaming is completed in contact with the target.

Accordingly, the portions of the tactical armored vehicle blanketed by foam are shielded from electromagnetic radiation in the wavelengths essential to control, communications, and target acquisition. The foam may be dyed for identification purposes.

While there have been described what is at present considered to be the preferred embodiment of a means disabling tactical armored vehicles, it will be obvious to those skilled in the art that various changes and modifications may be made therein without departing from the invention, and it is aimed therefore in the appended claims to cover all such changes and modifications as fall within the true spirit and scope of the invention.

What is claimed as the Invention is:

1. A warhead directed towards a preselected target comprising (a) a pyrotechnic gas generator to generate a gas, (b) a chamber separated from said pyrotechnic generator by a piston, said chamber containing polymeric components within which are suspended metallic flakes, (c) said polymeric components comprising either a one-component system maintained under pressure wherein the release of said pressure results in foam formation or a two-component system wherein the two components on contact react to form a foam, said one component system comprises a foaming component desolved in a volatile solvent under said pressure, the expulsion of said component from said chamber releasing said pressure; and said two-component system comprises components that on contact react to form a foam, said components contained within separate plastic film bags, the expulsion of said components from said chamber through a static mixer shreds said bags permitting said components to contact, (d) a proximity fusing device to ignite said pyrotechnic generator, said gas generated driving said piston into said chamber, expelling said foam-forming polymeric components from said chamber to passages wherein foam formation initiates, said foam thence passing from said passages to orifices to impinge upon said target, thereby blanketing a portion of said target with said foam, rendering said target ineffectual as a weapons system.

* * * * *